US008119957B2

(12) United States Patent
Wich

(10) Patent No.: US 8,119,957 B2
(45) Date of Patent: Feb. 21, 2012

(54) SUBMUNITION AND METHOD OF DESTROYING A TARGET IN A TARGET AREA BY THE SUBMUNITION

(75) Inventor: Harald Wich, Lauf (DE)

(73) Assignee: Diehl BGT Defence GmbH & Co. KG, Ueberlingen (DE)

( * ) Notice: Subject to any disclaimer, the term of this patent is extended or adjusted under 35 U.S.C. 154(b) by 225 days.

(21) Appl. No.: 12/503,124

(22) Filed: Jul. 15, 2009

(65) Prior Publication Data

US 2010/0011982 A1 Jan. 21, 2010

(30) Foreign Application Priority Data

Jul. 19, 2008 (DE) ..... 10 2008 033 827

(51) Int. Cl.

| | |
|---|---|
| ***F41G 7/28*** | (2006.01) |
| ***F41G 7/22*** | (2006.01) |
| ***G01S 13/88*** | (2006.01) |
| *F41G 7/00* | (2006.01) |
| *G01S 13/00* | (2006.01) |

(52) U.S. Cl. ..... 244/3.19; 89/1.11; 342/61; 342/62; 342/89; 342/90; 244/3.1; 244/3.15; 244/3.16

(58) Field of Classification Search ..... 244/3.1–3.19; 89/1.11; 342/61, 62, 89, 90, 175, 195, 52–56; 382/100, 103; 102/200, 206, 211, 213, 214, 102/382–384, 387, 473, 489

See application file for complete search history.

(56) References Cited

U.S. PATENT DOCUMENTS

| | | | | | |
|---|---|---|---|---|---|
| 4,242,962 | A | * | 1/1981 | Wakeman et al. | 102/213 |
| 4,492,166 | A | * | 1/1985 | Purcell | 102/384 |
| 4,522,356 | A | * | 6/1985 | Lair et al. | 244/3.15 |
| 4,554,871 | A | * | 11/1985 | Nixon | 102/489 |
| 4,858,532 | A | * | 8/1989 | Persson et al. | 102/387 |
| 5,668,346 | A | * | 9/1997 | Kunz et al. | 102/387 |

(Continued)

FOREIGN PATENT DOCUMENTS

| | | | | |
|---|---|---|---|---|
| DE | 3333517 | C2 | | 8/1987 |
| DE | 3843006 | A1 | | 6/1990 |
| DE | 19540252 | C2 | | 11/2003 |
| GB | 2167536 | A | | 5/1986 |
| GB | 2178144 | A | * | 2/1987 |
| GB | 2226466 | A | | 6/1990 |
| GB | 2414860 | A | * | 12/2005 |

OTHER PUBLICATIONS

"SMArt 155", GIWS Gesellschaft für Intelligente Wirksysteme mbH, 90478 Nurnberg, Aug. 2001.

*Primary Examiner* — Bernarr Gregory
(74) *Attorney, Agent, or Firm* — Laurence A. Greenberg; Werner H. Stemer; Ralph E. Locher

(57) ABSTRACT

A submunition is formulated for destroying a target in a target area. Accommodated in a casing are a signal processing unit connected to a radar antenna and/or an infrared sensor and/or another target-detecting sensor. The submunition further has target recognition software and a charge provided with a covering. To increase the versatility of use and to simultaneously improve detection and decision certainty and reliability, the target recognition software has a software interface for the transfer of at least one parameter specific to the target area.

16 Claims, 3 Drawing Sheets

U.S. PATENT DOCUMENTS

| | | | | |
|---|---|---|---|---|
| 6,481,666 | B2 * | 11/2002 | Frucht | 244/3.15 |
| 6,817,568 | B2 * | 11/2004 | Spate et al. | 244/3.15 |
| 7,219,853 | B2 * | 5/2007 | Williams | 244/3.14 |
| 7,494,089 | B2 * | 2/2009 | Williams et al. | 244/3.16 |
| 7,494,090 | B2 * | 2/2009 | Leal et al. | 244/3.16 |
| 7,533,849 | B2 * | 5/2009 | Zemany et al. | 244/3.16 |
| 7,745,767 | B2 * | 6/2010 | Bredy | 244/3.16 |
| 2007/0028791 | A1 * | 2/2007 | Bredy | 102/384 |

* cited by examiner

SUBMUNITION AND METHOD OF DESTROYING A TARGET IN A TARGET AREA BY THE SUBMUNITION

CROSS-REFERENCE TO RELATED APPLICATION

This application claims the priority, under 35 U.S.C. §119, of German application DE 10 2008 033 827.3-22, filed Jul. 19, 2008; the prior application is herewith incorporated by reference in its entirety.

BACKGROUND OF THE INVENTION

1. Field of the Invention

The invention concerns a submunition for destroying a target in a target area. Accommodated in a casing of the submunition are a signal processing unit connected to a radar antenna and/or an infrared sensor and/or another target-detecting sensor. The signal processing unit has target recognition software, and the submunition further has a charge provided with a covering. The invention further concerns a method of destroying a target in a target area by use of a submunition.

A submunition of the general kind set forth is known for example from the prospectus "SMArt 155" from GIWS Gesellschaft für Intelligente Wirksysteme mbH, 90478 Nuremberg from August 2001 and the prospectus "SMArt-D (AM)" from Diehl Munitionssysteme GmbH & Co. KG, 90552 Röthenbach a. d. Pegnitz from October 2000.

The known submunition is configured for shooting off with artillery shells. In that case a signal processing unit accommodated in a casing of the submunition is provided at the factory with target recognition software. It is stored in a preprogrammed memory chip of the signal processing unit or is stored in the memory chip during manufacture. After manufacture of the submunition the target recognition software can no longer be configured or modified.

The conventional submunition is configured for use scenarios in respect of which it is assumed that there are many targets, for example tanks, on a relatively even non-built-up surface. When using the conventional submunition in relation to other use scenarios, for example in a built-up area, false-positive target recognitions can occur.

SUMMARY OF THE INVENTION

It is accordingly an object of the invention to provide a submunition and a method of destroying a target in a target area by the submunition which overcomes the above-mentioned disadvantages of the heretofore-known devices and methods of this general type. The invention aims in particular to provide a submunition and a method of destroying a target in a target area, which are universal and which afford a level of precision which is as high as possible, that is to say a level of detection and decision certainty and reliability which is as high as possible.

With the foregoing and other objects in view there is provided, in accordance with the invention, a submunition for destroying a target in a target area. The submunition contains a radar antenna and a signal processing unit connected to the radar antenna and has target recognition software. The target recognition software has a software interface for a transfer of at least one parameter specific to the target area. A charge having a covering is provided. A casing accommodates the radar antenna, the signal processing unit and the charge.

In accordance with the invention it is provided that the target recognition software has a software interface for the transmission of at least one parameter specific to the target area. That makes it possible for the target recognition software of the submunition to be configured immediately prior to use thereof. In that way the specific factors of the target area can be taken into consideration substantially more accurately and consequently the level of precision, that is to say the level of detection and decision certainty and reliability of target acquisition, can be improved. The proposed submunition is therefore particularly universal.

In accordance with the present invention the term "software interface" is to be interpreted generally. This involves in particular a program portion of the target recognition software, with which data exchange is possible by way of a hardware interface with an external data processing unit. In particular correct association of the received data or parameters with the program portions, intended for same, of the target recognition software is effected with the software interface. The term "parameter" in accordance with the present invention is used in the simplest case to denote a data set describing a property of the target area or a condition prevailing there. The parameter however may also be more complex data sets or also program portions which for example can supplement the target recognition software in the manner of "add-ons". If the parameters involve program portions algorithms for enhancing the precision of data recognition can also be contained therein.

In accordance with an advantageous configuration the submunition has a hardware interface connected to the signal processing unit. The hardware interface can be a parallel or serial interface. It can be an interface for wired or wireless data transfer. In the case of wired data transfer it has proven desirable to provide for example on the casing a jack for inserting a data transfer cable. This can involve for example a USB port. The hardware interface however can also be an interface for wireless data transfer. In that respect it can for example involve an infrared interface, a Bluetooth interface or the like. A wired hardware interface is appropriate in particular when launching submunition by rockets or dispersers as here a cable connection is made to the rocket or the dispenser for configuration thereof in any case prior to the launch by way of what is referred as a "umbilical cord". That cable wired connection can be used when employing the submunition according to the invention, for transfer of the at least one parameter. An interface for wireless data transfer is considered in particular when dispensing the submunition by artillery shells.

In accordance with an advantageous configuration the at least one parameter is selected from the following group: day/night parameter, temperature, clock time, terrain morphology, and target category. The day/night parameter indicates whether it is day or night at the time of launching the submunition. In that way it is possible for example to take account of the solar background for adjustment as precisely as possible of the IR channel. Likewise taking account of the prevailing temperature or outside temperature permits improved target recognition with the IR channel. It is possible to indicate the position of the sun with the clock time, and that in turn further improves target recognition. Furthermore items of information about the "terrain morphology" of the target area can be communicated as the parameter to the target recognition software. Those items of information include information about the possible presence of buildings, areas of water, the surface nature to be expected, vegetation and the like.

In accordance with a further particularly advantageous configuration the target recognition software includes a multiplicity of predetermined configurations, of which one is selected as a consequence of the transferred parameter and the target recognition software is correspondingly configured. It is desirable in any event if the target recognition software is basically preconfigured so that it is operable in a conventional manner even without the communication of at least one parameter. As a consequence of the communication of the at least one parameter it is possible to select a configuration which is particularly suitable for the respective use scenario and which replaces the preconfiguration, using tables which are predetermined in the target recognition software and/or switches or software switches.

In accordance with the present invention there is provided an infrared sensor connected to the signal processing unit. Besides the radar device the infrared sensor additionally serves for target recognition. In addition a parachute can be accommodated in the casing, which permits a rotating movement of the submunition during the descent or search phase.

In accordance with a further aspect of the invention there is proposed a method of destroying a target in a target area by use of a submunition, wherein accommodated in a casing are a signal processing unit connected to a radar antenna and/or an infrared sensor and/or another target-detecting sensor, and a charge provided with a covering. The method includes the following steps: providing a target recognition software for the signal processing unit; providing at least one parameter specific to the target area on a data processing unit; transferring the at least one parameter from the data processing unit to the target recognition software by way of a software interface provided in the target recognition software; and configuring the target recognition software using the at least one parameter.

In accordance with the proposed method the target recognition software is configured for the signal processing unit, using a data processing unit which is different from the signal processing unit, for example a computer, with at least one parameter specific to the target area. In that way the submunition can also be universally employed in target areas for which it was previously not suitable.

In that respect in accordance with a variant it is provided that the target recognition software is present stored in the signal processing unit. In that case the parameter is transferred from the data processing unit by way of the software interface to the target recognition software stored in the signal processing unit. In accordance with a further variant the target recognition software can also first be previously held in the data processing unit and configured using the parameter. It can then be subsequently transferred to the signal processing unit in configured form. In accordance with a further variant it is also possible for substantial parts of the target recognition software to be already present stored in the signal processing unit and for only further program portions which are required for the configuration procedure to be downloaded from the data processing unit into the signal processing unit. In that case the program portions contain the at least one parameter specific to the target area.

In accordance with a further configuration a connection is made to the data processing unit by way of a hardware interface connected to the signal processing unit, for transfer of the parameter or the target recognition software which is configured using the parameter. The hardware interface can be an interface for wired or wireless data transfer.

In regard to the further configurations of the method attention is directed to the foregoing description relating to the submunition. The features described there can in the same fashion form features of the method.

Other features which are considered as characteristic for the invention are set forth in the appended claims.

Although the invention is illustrated and described herein as embodied in a submunition and a method of destroying a target in a target area by the submunition, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DETAILED DESCRIPTION OF THE INVENTION

Figure 1:
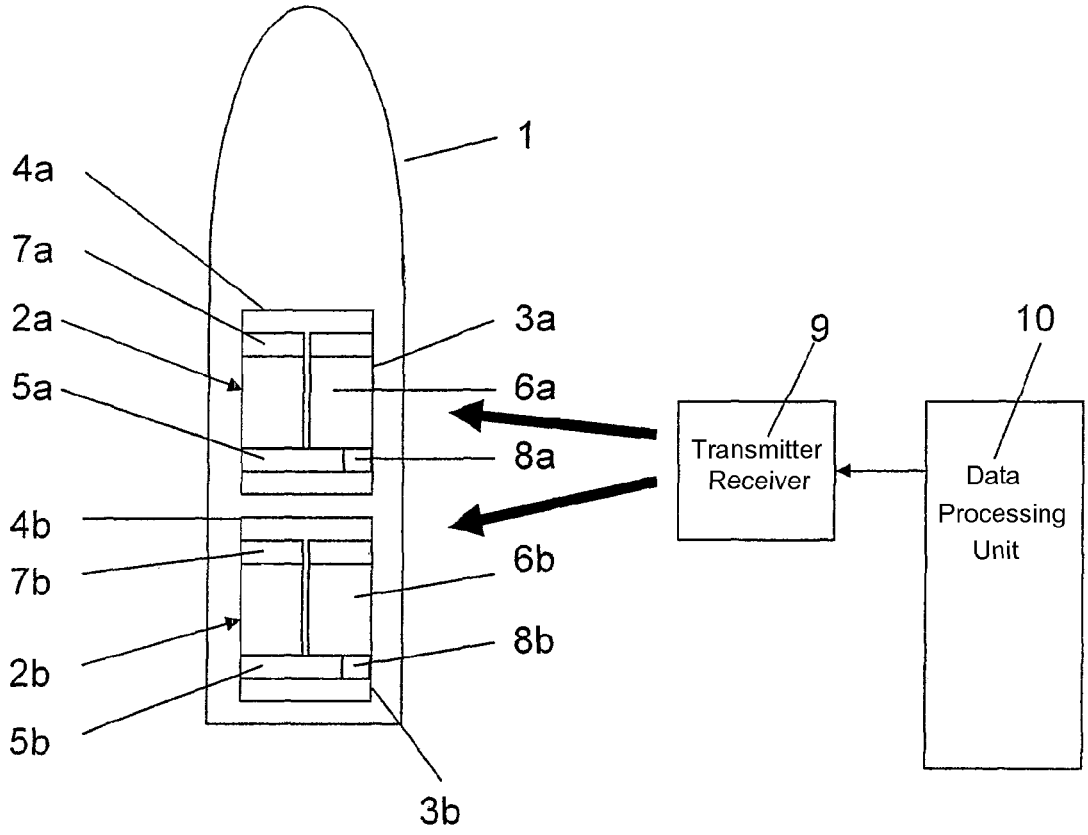
FIG. 1 is a diagrammatic view of an artillery shell with submunition units in conjunction with a data processing unit according to the invention.

Referring now to the figures of the drawing in detail and first, particularly, to FIG. 1 thereof, there is shown an artillery shell 1 in which two submunition units 2*a*, 2*b* are accommodated. Each of the submunition units 2*a*, 2*b* has a casing 3*a*, 3*b* in which there is accommodated a signal processing unit 5*a*, 5*b* connected to a radar antenna 4*a*, 4*b*. Disposed between the radar antenna 4*a*, 4*b* and the signal processing unit 5*a*, 5*b* is a respective charge 6*a*, 6*b* provided at a side towards the radar antenna 4*a*, 4*b* with a covering 7*a*, 7*b* which can be a metal plate. Each of the signal processing units 5*a*, 5*b* has a hardware interface 8*a*, 8*b* for wireless data transfer. Reference 9 denotes a transmitting/receiving device for wireless data exchange with the hardware interface 8*a*, 8*b*. The transmitting/receiving device is connected to a data processing unit 10.

The mode of operation of the configuration shown in FIG. 1 is now described.

The signal processing unit 5*a*, 5*b* is programmed with target recognition software which has been downloaded into the signal processing unit 5*a*, 5*b* at the manufacturer, for example by way of the hardware interface 8*a*, 8*b*. The target recognition software has a software interface permitting data exchange and in particular downloading of at least one parameter, preferably a plurality of parameters or further program portions. The software interface is preferably programmed in such a way that, in the event of reception of at least one parameter and/or a further program portion, the data recognition software is automatically configured, using the received data. In that respect a preliminary configuration which is already present can be partially or completely modified. The new configuration of the target recognition software can be afforded by a configuration being selected from a multiplicity of configurations provided in the target recognition software, and by that selected configuration subsequently entirely or partially replacing the preliminary configuration. The multiplicity of configurations can be stored in tables or switches.

A day/night parameter, a currently prevailing clock time, items of weather information such as a degree of cloud cover, precipitation, wind speed, wind direction and the like, ambient temperature, terrain morphology, a ground echo to be expected, specific parameters relating to particularities of a target to be expected and the like can be communicated as the parameter for modifying the target recognition software. In that way in particular filters for an IR channel, an active radar channel or a passive radar channel can be precisely adjusted. In addition suitable algorithms for signal processing can be selected and thus particularly secure and reliable target acquisition can be achieved.

Figure 2:
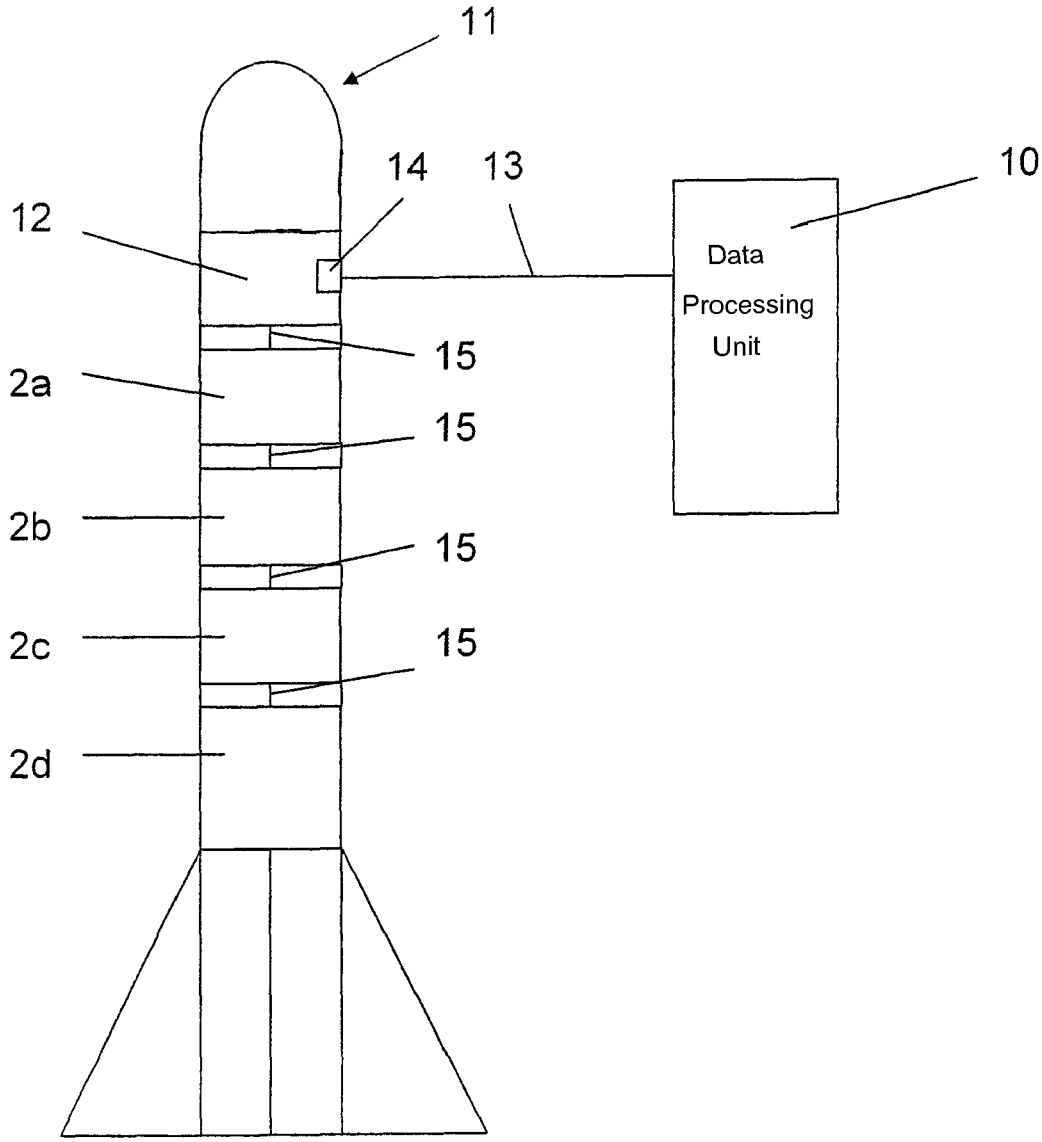
FIG. 2 is an illustration of a rocket with the submunition units in conjunction with a data processing unit.

FIG. 2 shows a rocket 11 in which four submunition units 2*a*, 2*b*, 2*c*, 2*d* are accommodated. A control unit 12 with which the rocket 11 is guided into a target area is connected to the data processing unit 10 for the transfer of suitable control parameters in conventional fashion by way of a first cable connection 13 or an "umbilical cord". A plug jack or port 14 is provided for that purpose in the control unit 12 as the hardware interface. The submunition units 2*a*, 2*b*, 2*c*, 2*d* are connected in parallel to the data processing unit 10 by way of a second cable connection 15. Desirably the plug jack or port 14 and the first cable connection 13 are also used here for data transfer. It will be appreciated that it can also be the case that each of the submunition units 2*a*, 2*b*, 2*c*, 2*d* is connected to the data processing unit 10 by way of further plug jacks or ports provided thereon (not shown here) and separate further cable connections connected thereto. In addition it may also be the case that—similarly to the situation shown in FIG. 1—the submunition units 2*a*, 2*b*, 2*c*, 2*d* are provided with a hardware interface for wireless data exchange.

In the illustrated embodiments it may also be the case that the submunition units are provided with a signal processing unit 5*a*, 5*b* which is not programmed with target recognition software. In that case the target recognition software is previously held in the data processing unit 10 and configured prior to use with suitable parameters. The configured target recognition software can then be downloaded into the signal processing unit. That variant has the advantage that, in the case of use of the submunition, it is possible to use the most up-to-date target recognition software which is then respectively available.

Figure 3:
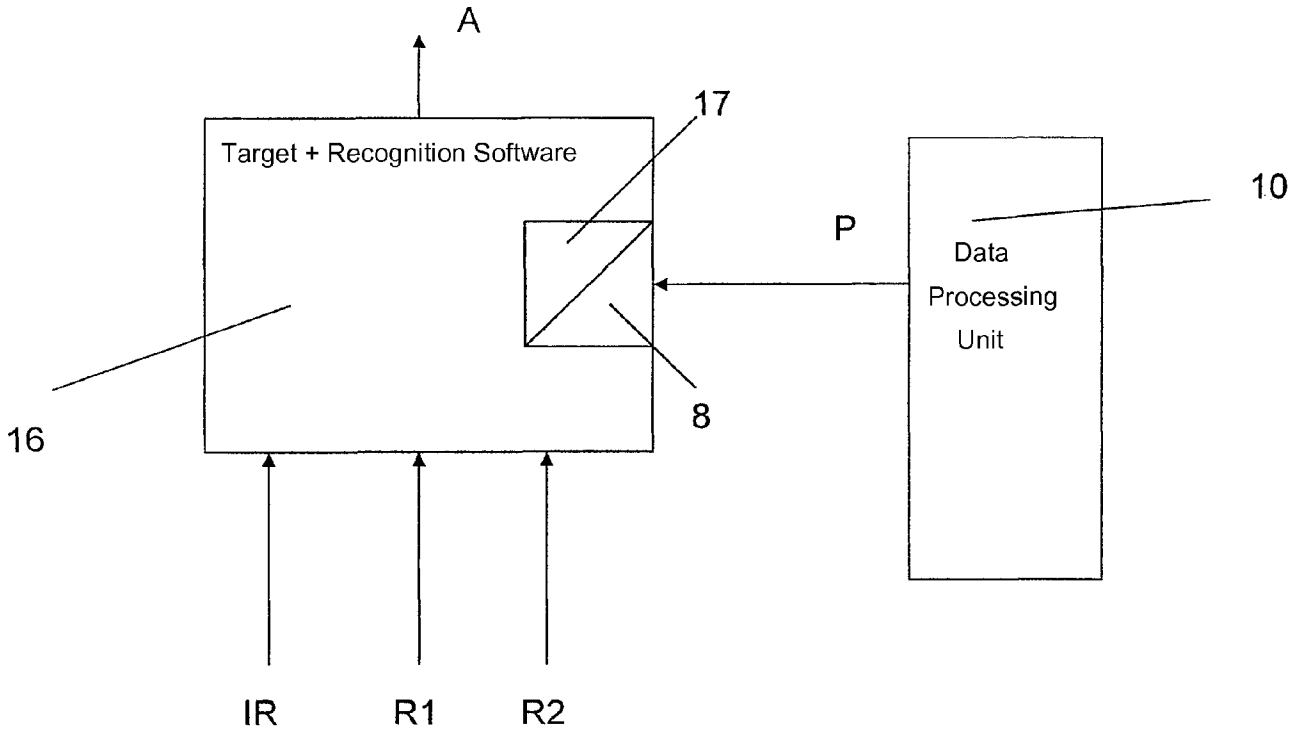
FIG. 3 is a diagrammatic view relating to the configuration of the target recognition software.

FIG. 3 shows once again diagrammatically the configuration of the target recognition software which is here generally identified by reference 16. The target recognition software 16 receives first signals IR from an infrared sensor, second signals R1 from an active radar sensor and third signals R2 from a passive radar sensor. The received signals IR, R1, R2 are analyzed by the target recognition software 16 and predetermined algorithms are used to ascertain whether a target has been acquired with the infrared and radar sensors. If that is the case a fourth signal A is triggered, with which the charge 6*a*, 6*b* is fired.

To increase the security and reliability of the calculations, parameters P can be downloaded from the data processing unit 10 by way of the hardware interface 8 and a software interface 17 and implemented into the target recognition software 16.

The invention claimed is:

1. A submunition for destroying a target in a target area, the submunition comprising:

a radar antenna;

a signal processing unit connected to said radar antenna and having target recognition software, said target recognition software having a software interface for a transfer of at least one parameter specific to the target area;

a charge having a covering; and a casing accommodating said radar antenna, said signal processing unit and said charge.

2. The submunition according to claim 1, further comprising a hardware interface connected to said signal processing unit.

3. The submunition according to claim 2, wherein said hardware interface is an interface for one of a wired data transfer and a wireless data transfer.

4. The submunition according to claim 1, wherein the at least one parameter is selected from the group consisting of day/night parameters, temperature, clock time, terrain morphology and target category.

5. The submunition according to claim 1, wherein said target recognition software includes a multiplicity of predetermined configurations, of which one is selected as a consequence of the parameter transferred, and said target recognition software is correspondingly configured.

6. The submunition according to claim 1, further comprising a parachute accommodated in said casing.

7. The submunition according to claim 1, further comprising an infrared sensor accommodated in said casing.

8. The submunition according to claim 1, further comprising a target-detecting sensor accommodated in said casing.

9. A method of destroying a target in a target area by means of a submunition, the submunition having accommodated in a casing, a radar antenna, a signal processing unit connected to the radar antenna, and a charge having a covering, which comprises the steps of:

providing target recognition software to the signal processing unit;

providing at least one parameter specific to the target area to a data processing unit;

transferring the at least one parameter from the data processing unit to the target recognition software by way of a software interface provided in the target recognition software; and configuring the target recognition software using the at least one parameter.

10. The method according to claim 9, which further comprises transferring the parameter by way of the software interface to the target recognition software stored in the signal processing unit.

11. The method according to claim 9, which further comprises transferring the target recognition software, which is configured using the parameter, to the signal processing unit.

12. The method according to claim 9, which further comprises making a connection to the data processing unit by way of a hardware interface connected to the signal processing unit for transfer of one of the parameter and the target recognition software configured using the parameter.

13. The method according to claim 12, which further comprises configuring the hardware interface as an interface for one of wired data transmission and wireless data transmission.

14. The method according to claim 9, which further comprises selecting the parameter from the group consisting of a day/night parameter, temperature, clock time, terrain morphology and target category.

15. The method according to claim 9, wherein the target recognition software contains a multiplicity of predetermined configurations, of which one is selected as a consequence of the parameter transferred and the target recognition software is correspondingly configured.

16. The method according to claim 9, which further comprises formulating the submunition with at least one of an infrared sensor and another target-detecting sensor.

* * * * *